US007131824B2

(12) United States Patent
Baron

(10) Patent No.: US 7,131,824 B2
(45) Date of Patent: Nov. 7, 2006

(54) WHEELED PORTABLE AIR COMPRESSOR

(75) Inventor: Michael P Baron, Phoenix, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/102,902

(22) Filed: Apr. 8, 2005

(65) Prior Publication Data

US 2005/0175475 A1 Aug. 11, 2005

Related U.S. Application Data

(63) Continuation of application No. PCT/US03/31829, filed on Oct. 9, 2003.

(60) Provisional application No. 60/417,725, filed on Oct. 10, 2002.

(51) Int. Cl.
*F04B 17/00* (2006.01)

(52) U.S. Cl. ..... 417/362; 417/364

(58) Field of Classification Search ..... 417/362, 417/364, 201
See application file for complete search history.

(56) References Cited

U.S. PATENT DOCUMENTS

| | | | | |
|---|---|---|---|---|
| 1,717,847 | A * | 6/1929 | Litle, Jr. | 417/362 |
| 2,479,170 | A * | 8/1949 | Kuempel | 62/230 |
| 3,885,892 | A | 5/1975 | Dwyer et al. | |
| 4,132,088 | A | 1/1979 | Grosskopf | |
| 4,190,402 | A | 2/1980 | Meece et al. | |
| 4,492,533 | A | 1/1985 | Tsuge | |
| 4,536,132 | A | 8/1985 | Tenney | |
| 4,729,722 | A | 3/1988 | Toth | |
| 4,869,641 | A | 9/1989 | Hufgard | |
| 5,020,973 | A | 6/1991 | Lammers | |
| 5,116,207 | A | 5/1992 | Doolittle et al. | |
| 5,137,434 | A | 8/1992 | Wheeler et al. | |
| 5,181,840 | A | 1/1993 | Zecchini | |
| 5,378,119 | A | 1/1995 | Goertzen | |
| 5,584,675 | A | 12/1996 | Steurer et al. | |
| 5,931,207 | A | 8/1999 | Gianino | |
| 6,210,132 | B1 | 4/2001 | Shiinoki et al. | |
| 6,364,632 | B1 | 4/2002 | Cromm et al. | |
| 6,375,437 | B1 | 4/2002 | Nolan | |
| 6,386,833 | B1 | 5/2002 | Montgomery | |
| 6,431,839 | B1 | 8/2002 | Gruber et al. | |
| 6,447,257 | B1 | 9/2002 | Orschell | |
| 6,474,954 | B1 | 11/2002 | Bell et al. | |
| 6,485,266 | B1 | 11/2002 | DeRuyter | |
| 2003/0095877 | A1 | 5/2003 | Graber et al. | |
| 2004/0018098 | A1 | 1/2004 | Beckman et al. | |

FOREIGN PATENT DOCUMENTS

| | | |
|---|---|---|
| DE | 1 958 559 | 4/1967 |
| DE | 1 628 186 | 11/1971 |
| DE | 26 37 853 | 3/1978 |
| DE | 38 06 289 | 9/1989 |

* cited by examiner

*Primary Examiner*—Charles G. Freay
(74) *Attorney, Agent, or Firm*—Harness, Dickey & Pierce, P.L.C.

(57) ABSTRACT

A portable air compressor (10) includes a motor (24) having an output shaft (76) and a compressor (18) having an input shaft (66). The compressor (18) further includes a lower mounting surface (64) and an upper cooling surface (60). The upper cooling surface (60) lies in a common plane with the output shaft (76) of the motor (24). A drive linkage (26) operably couples the output shaft (76) of the motor (24) for concurrent rotation with the input shaft (66) of the compressor (18). A fan (80) is coupled for rotation with the output shaft (76) of the motor (24) and directs air across the upper cooling surface (60).

20 Claims, 5 Drawing Sheets

WHEELED PORTABLE AIR COMPRESSOR

CROSS-REFERENCE TO RELATED APPLICATIONS

This application is a continuation of international patent application PCT/US2003/031829, filed Oct. 9, 2003 and designating the U.S., which was published under PCT Article 21(2) in English, and claims priority of U.S. Patent Application No. 60/417,725, filed Oct. 10, 2002.

FIELD OF THE INVENTION

The present invention relates to portable air compressors and more particularly to an air compressor fan cooling configuration.

BACKGROUND OF THE INVENTION

An air compressor may be used to provide a hand-held tool with pneumatic power. The compressor is part of an assembly that further includes a prime mover for driving the compressor and a tank for storing compressed air. The prime mover may include an electric motor or an internal combustion engine.

A drive assembly operatively interconnects the motor with the compressor to transfer torque from the motor to the compressor. A conventional drive assembly may include a pulley, a flywheel and a linkage mechanism that cooperate to reciprocate a piston within the compressor upon rotation of an output shaft of the motor. The reciprocating piston pumps compressed air into the tank. A pneumatic power hose extends from the tank to the pneumatically powered tool. The motor and compressor assembly may be mounted on a frame including wheels and a handle allowing portability.

SUMMARY OF THE INVENTION

An air compressor pump includes a motor having an output shaft. A compressor includes an input shaft, a lower mounting surface and an upper cooling surface. The upper cooling surface lies in a common plane with the output shaft. A drive linkage operably couples the output shaft for concurrent rotation with the input shaft. A first fan is coupled for rotation with the output shaft. The first fan directs air across the upper cooling surface upon rotation of the output shaft.

In other features, the first fan draws air across the cooling surface and dispenses the air radially. The drive linkage includes a belt connecting the input shaft with the output shaft. The input and output shafts are laterally disposed. A shroud is disposed over a portion of the drive linkage and a grill is disposed around the first fan. A second fan is coupled for rotation with the input shaft and directs air toward the compressor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
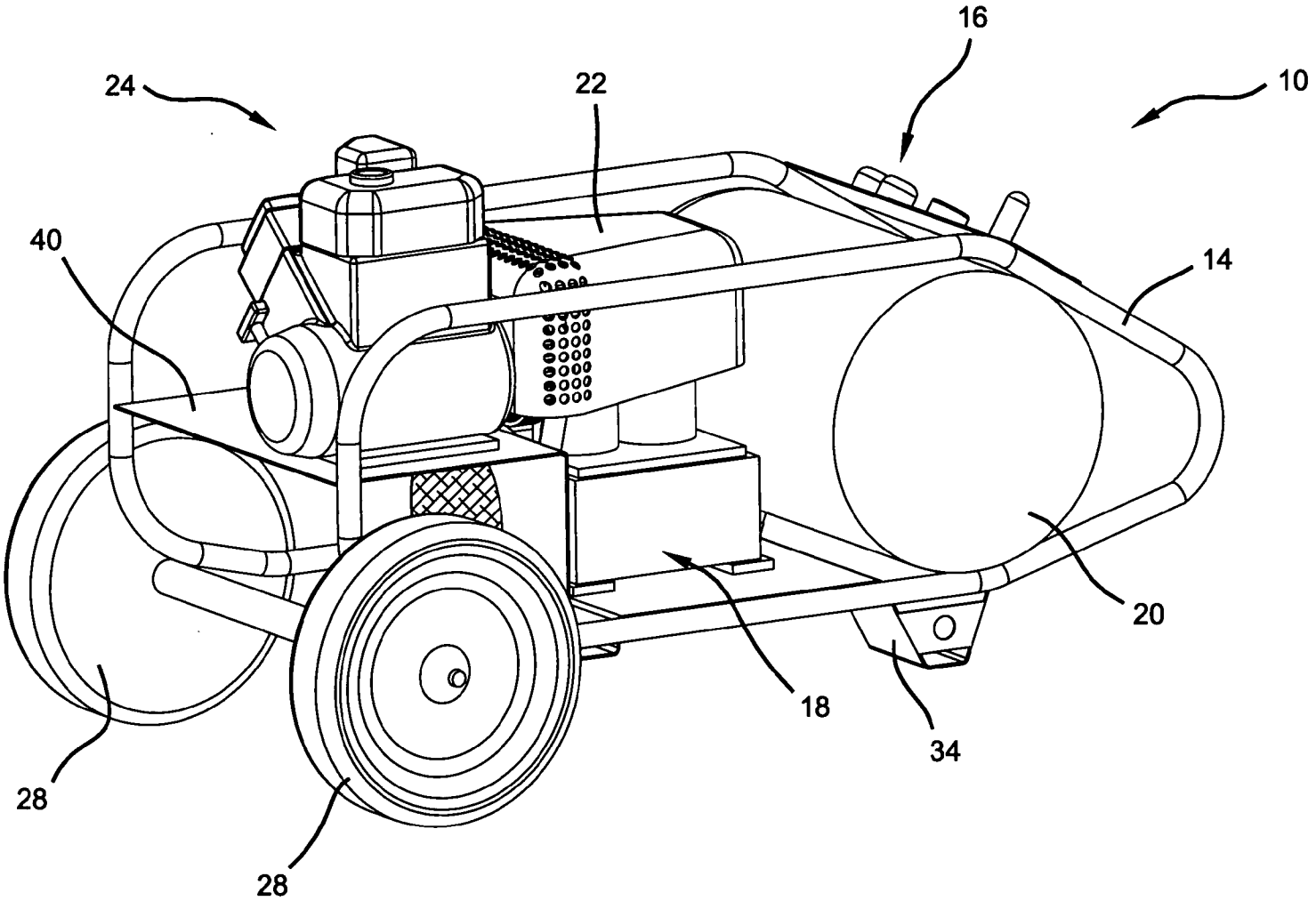
FIG. 1 is a perspective view of the portable air compressor according to the teachings of the present invention.

The following description of the preferred embodiment(s) is merely exemplary in nature and is in no way intended to limit the invention, its application, or uses. For purposes of clarity, the same reference numbers will be used in the drawings to identify similar elements.

Figure 2:
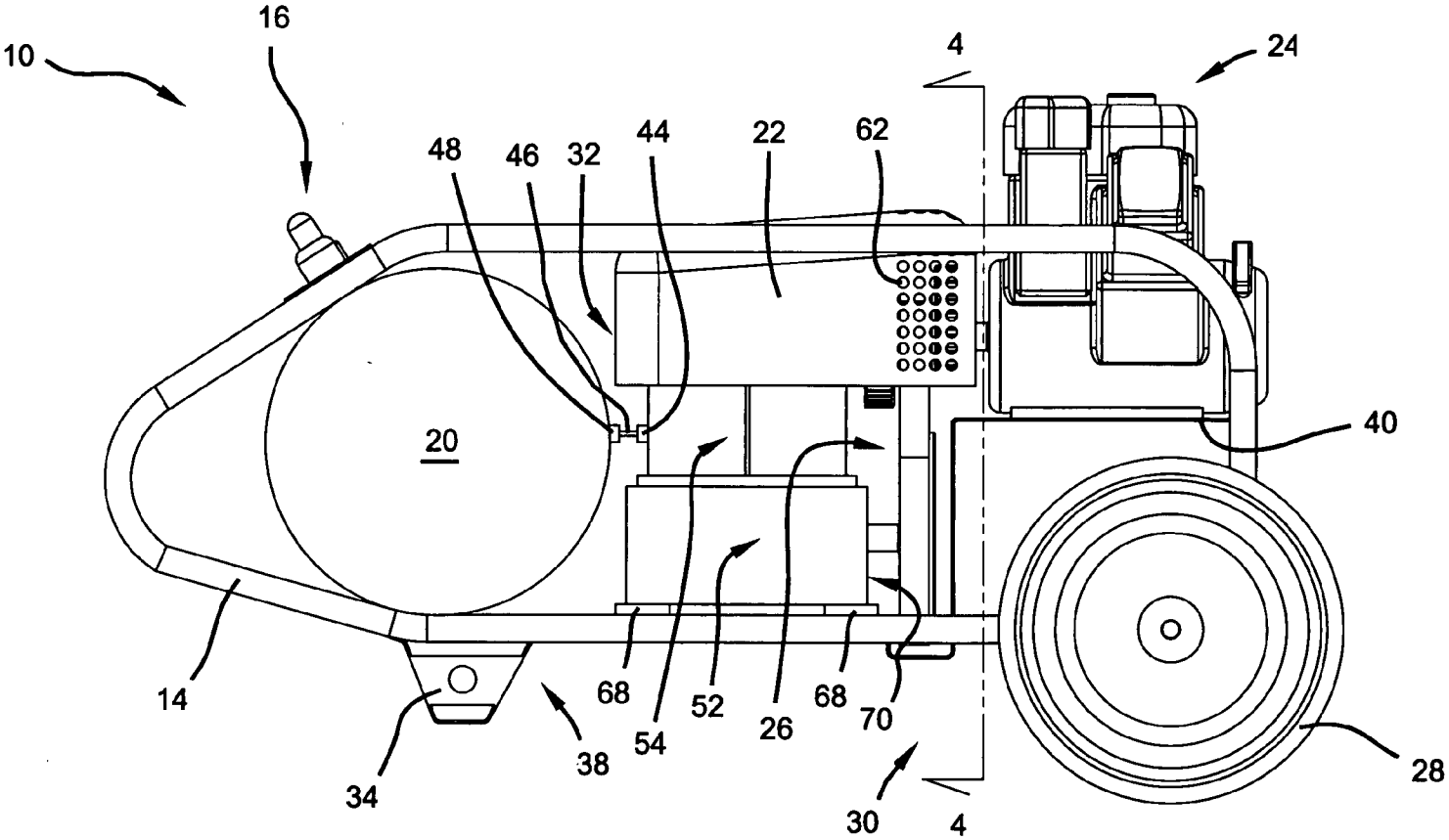
FIG. 2 is a side view of the portable air compressor.

With initial reference to FIGS. 1 and 2, a portable air compressor assembly according to the present invention is illustrated and generally identified at reference 10. The portable air compressor 10 includes a frame 14 which carries a power operated air compressor 18 and an air containing structure or tank 20. The air compressor 18 is driven by a gasoline engine 24 through a drive assembly 26. It is appreciated however that other power generating devices may be employed to operate the compressor 18 such as an electric motor for example.

The frame 14 includes a pair of wheels 28 coupled for rotation on a first end 30 and a pair of legs 34 extending from an opposite end 38. A control panel 16 is arranged on the frame 14. The control panel 16 preferably includes a pressure gauge and may also include other gauges related to the engine 24 or the compressor 18. A support platform 40 extends from the frame 14 and supports the engine 24 in a raised position with respect to the compressor 18. The engine 24 and the compressor 18 are preferably arranged laterally with respect to a longitudinal axis of the frame 14. A protective shroud 22 is fixedly mounted over an upper portion of the compressor 18 and the drive assembly 26.

When the compressor 18 is powered by the engine 24 it is operable to provide a source of air under pressure to the tank 20. The compressor 18 is of the type including dual internal cylinders containing pistons (not shown). Reciprocal movement of the pistons pump air from an outlet port 44 on the compressor 18 through an air line 46 to an inlet port 48 on the tank 20. The compressor 18 may comprise alternative piston configurations such as a single piston for example. The air is retained in the tank 20 and is released according to user request through a pneumatic air hose (not shown).

Figure 3:
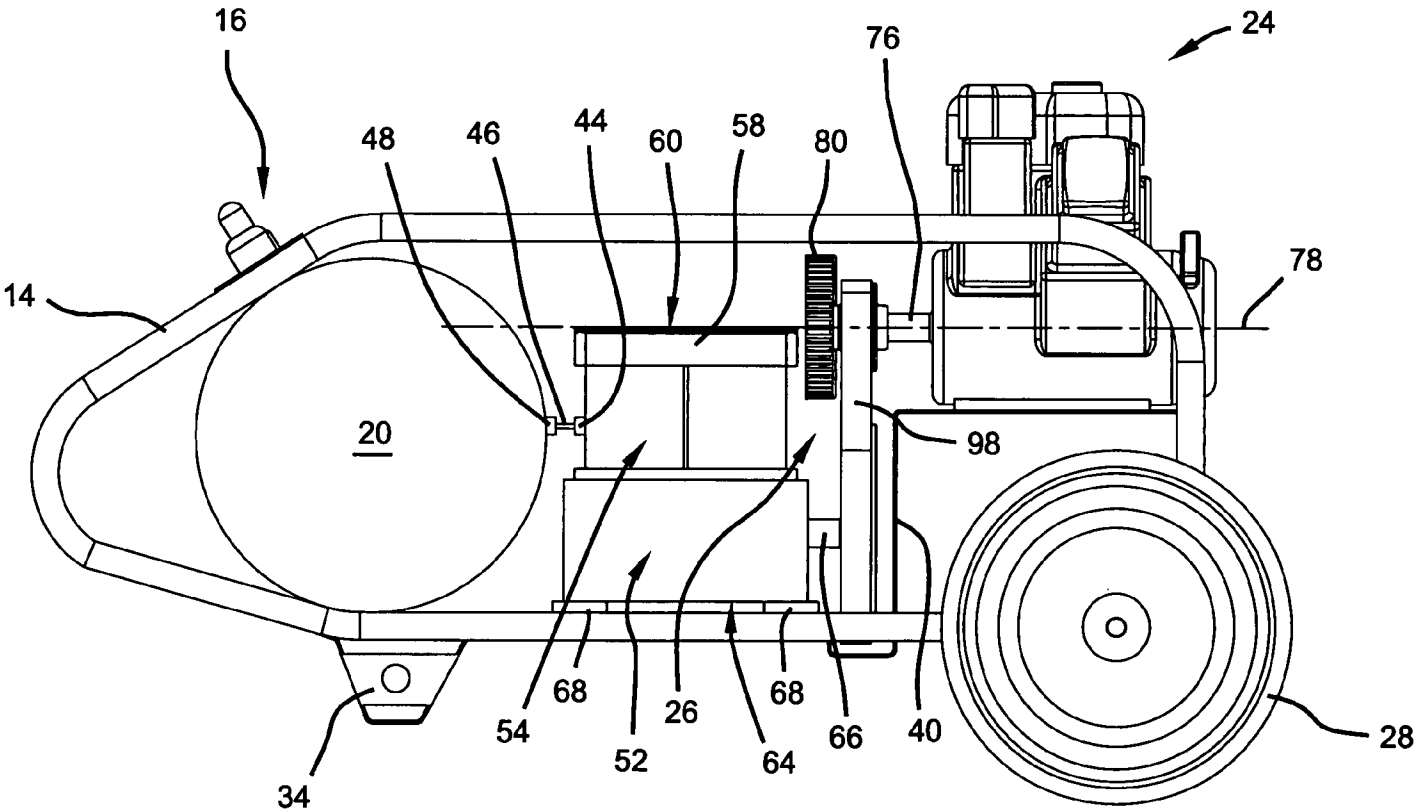
FIG. 3 is a side view of the portable air compressor shown with the shroud removed for illustration.

With reference now to FIGS. 2 and 3, the compressor 18 defines a substantially box-like structure including a lower portion 52 and an upper portion 54. The compressor 18 includes a head 58 having an upper cooling surface 60 defining an upper cooling plane. A lower mounting surface 64 lies on an opposite end of the upper cooling surface 60. The compressor 18 is fixedly mounted in an upright position on the frame 14 at compressor mounts 68. The compressor mounts 68 preferably provide compliance to assist in vibration dissipation of the compressor 18 during operation.

The upper portion 54 of the compressor 18 houses the pistons. The pistons are each supported for reciprocating movement along a respective vertical axis. Inlet and outlet valves (not shown) are incorporated on the upper portion 54 of the compressor 18. The valves allow air to pass through the upper portion 54 of the compressor 18 to the outlet port 44 under the influence of the pistons.

A gearing arrangement (not shown) is provided in the lower portion 52 of the compressor 18 to transfer rotational movement of an input shaft 66 into linear actuation of the pistons within the upper portion 54 of the compressor 18. The input shaft 66 is rotatably supported by and extends through a bearing (not shown) arranged on rear face 70 of the lower portion 52 of the compressor 18.

The tank 20 is in the form of a single tank fixedly mounted in a transverse relationship with respect to the frame 14. The tank 20 may alternatively be arranged laterally with respect to the frame 14. In addition, the compressor assembly 10 may include tank arrangements such as a pair of tanks mounted in a parallel relationship.

With continued reference to FIG. 3 and further reference to FIGS. 4 and 5, the drive assembly 26 will be described in greater detail. The engine 24 has an output shaft 76 defining a longitudinal central axis 78. A terminal end of output shaft 76 includes a first cooling fan 80 coupled thereto. A drive wheel 82 is disposed on the output shaft 76 inboard of the first cooling fan 80. The input shaft 66 of the compressor 18 defines a longitudinal central axis 88.

The input shaft 66 includes a flywheel 96 disposed on a terminal end thereof. A second cooling fan 92 is incorporated on the flywheel 96. The longitudinal axis 78 of the output shaft 76 and the longitudinal axis 88 of the input shaft 66 are preferably arranged in a parallel relationship. The output shaft 76 and the input shaft 66 are also preferably arranged in a lateral relationship with respect to the longitudinal axis of the frame 14. A drive belt 98 transmits torque from the drive wheel 82 on the output shaft 76 to the flywheel 96 on the input shaft 66. The second cooling fan 92 ingests air through a grill 100 incorporated on the engine support structure 40. Alternatively, an idler pulley may be incorporated to provide additional clearance for components potentially impeding the rotation of the drive belt 98.

Figure 4:
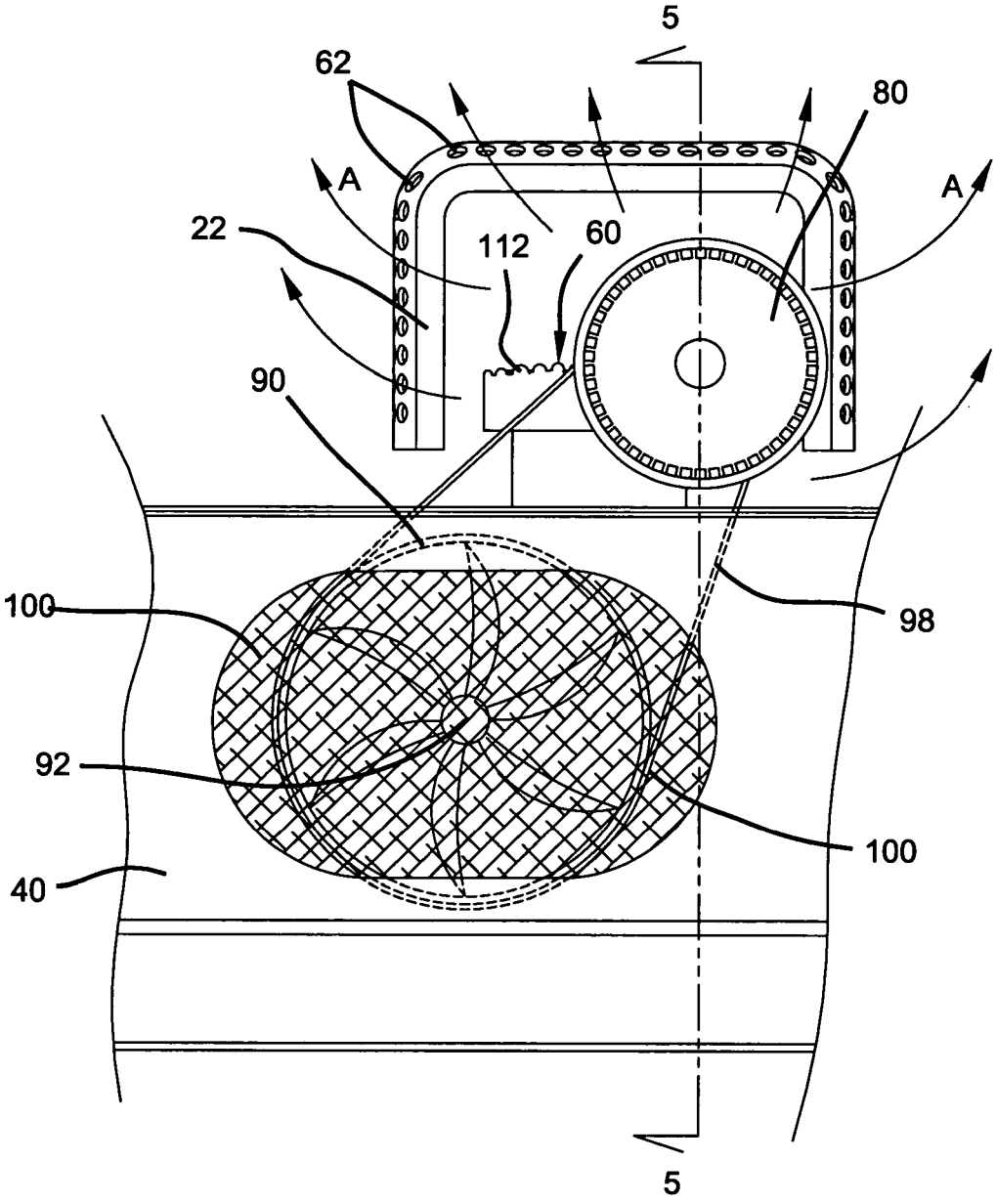
FIG. 4 is a sectional view of the portable air compressor taken along line 4—4 of FIG. 2.
Figure 5:
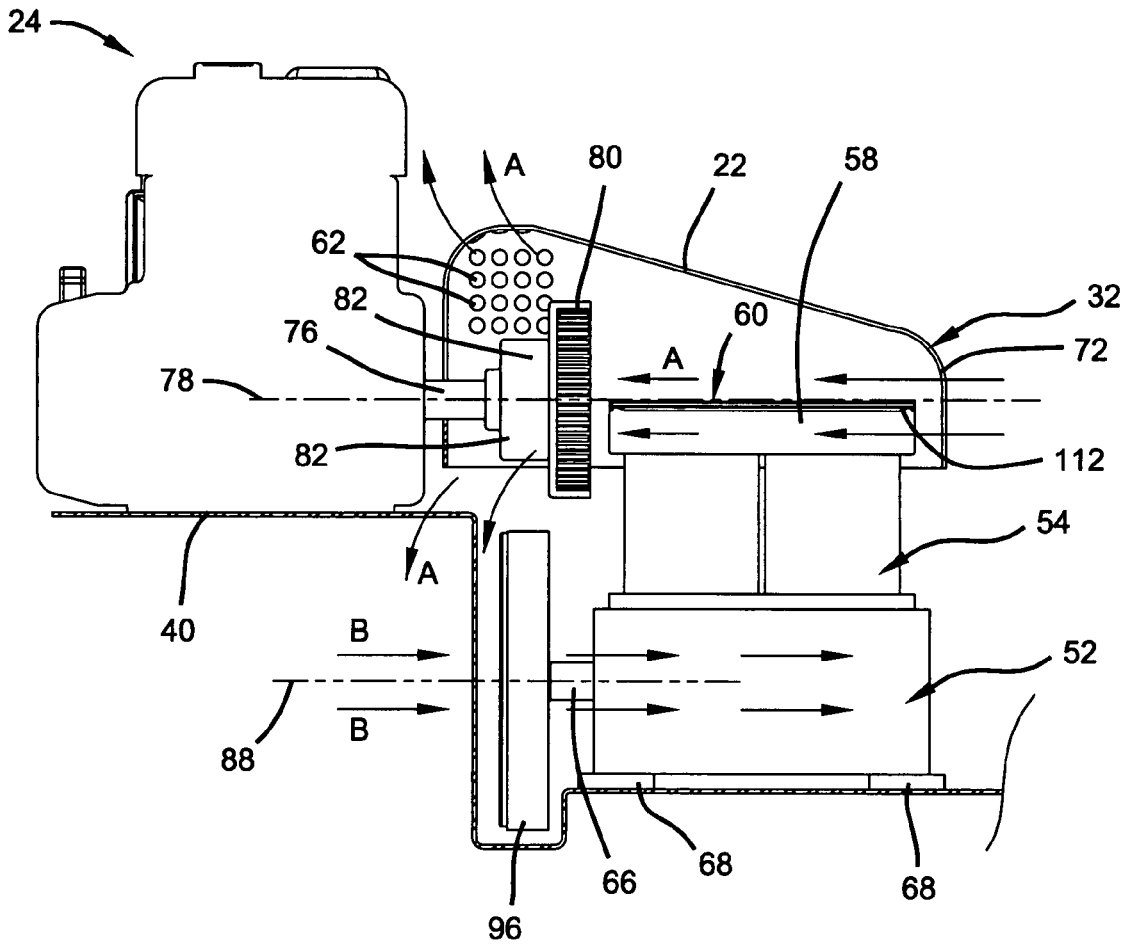
FIG. 5 is a sectional view of the portable air compressor taken along line 5—5 of FIG. 4.

With reference now to FIGS. 4 and 5, the operation of the cooling fans 80, 92 will be described. The first cooling fan 80 is preferably a radial fan. It will be appreciated that cooling fan 80 may comprise alternative forms such as an axial fan for example. The longitudinal axis 78 of the engine output shaft 76 lies on a substantially common plane as the upper cooling surface 60 of the compressor 18. In this way, the first cooling fan 80 draws air through a cutout 72 on a front face 32 of the shroud 22. The air is directed across the upper cooling surface 60 of the compressor 18 and is discharged radially through a grill 62 in the direction generally identified at reference A. Shroud 22 may alternatively comprise a solid front face 32. The second cooling fan 92 directs air toward the rear face 70 and consequently around the compressor 18 in the direction generally identified at reference B.

A significant amount of heat generated by the compressor 18 is realized at the head 58. The head 58 includes fins 112 formed thereon to facilitate heat dissipation thereat. The alignment of the first cooling fan 80 with respect to the head 58 encourages a high rate of air flow over the head and, as a result, increased heat dissipation. The arrangement of the engine 24, the first cooling fan 80 and the compressor 18 also encourages ambient air to be drawn over the head 58. In this way, air is being pulled from an area substantially uninfluenced by heat generated by the engine 24.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An air compressor pump comprising:

a motor having an output shaft;

a compressor having an input shaft, a lower mounting surface and an upper cooling surface, said upper cooling surface lying in a common plane with said output shaft;

a drive linkage operably coupling said output shaft for concurrent rotation with said input shaft; and a first fan coupled for rotation with said output shaft, said first fan directing air across said upper cooling surface upon rotation of said output shaft.

2. The air compressor pump of claim 1 wherein said fan draws air across said cooling surface and dispenses said air radially outward.

3. The air compressor pump of claim 1 wherein said drive linkage includes a belt connecting said input shaft with said output shaft.

4. The air compressor pump of claim 1 wherein said input shaft and said output shaft are laterally displaced.

5. The air compressor pump of claim 4 wherein said input shaft and said output shaft are parallel.

6. The air compressor pump of claim 1, further comprising a shroud disposed over a portion of said drive linkage.

7. The air compressor pump of claim 1, further comprising a grill disposed around said fan.

8. The air compressor pump of claim 1, further comprising a second fan coupled for rotation with said input shaft, said second fan directing air toward said compressor.

9. The air compressor pump of claim 1 wherein said motor and said compressor are fixedly mounted to a frame.

10. The air compressor pump of claim 9 wherein said motor and said compressor are arranged laterally with respect to a longitudinal axis of said frame.

11. The air compressor pump of claim 9 wherein said output shaft of said motor and said input shaft of said compressor are arranged laterally with respect to a longitudinal axis of said frame.

12. An air compressor pump comprising:

a motor having an output shaft;

a compressor having an upper cooling surface and an input shaft laterally displaced from and coupled for rotation with said output shaft by a drive linkage, said upper cooling surface lying in a common plane with said output shaft; and a first fan coupled for rotation with said output shaft, said first fan directing air across said upper cooling surface upon rotation of said output shaft.

13. The air compressor pump of claim 12 wherein said first fan draws air across said cooling surface and dispenses said air radially outward.

14. The air compressor pump of claim 12 wherein said drive linkage includes a belt connecting said input shaft with said output shaft.

15. The air compressor pump of claim 12, further comprising a second fan coupled for rotation with said input shaft, said second fan directing air toward said compressor.

16. The air compressor pump of claim 12 wherein said output shaft of said motor and said input shaft of said compressor are arranged laterally with respect to a longitudinal axis of said frame.

17. An air compressor pump comprising:

a motor having an output shaft;

a compressor having an upper cooling surface and an input shaft coupled for rotation with said output shaft, said upper cooling surface lying in a common plane with said output shaft;

a first fan coupled for rotation with said output shaft, said first fan directing air across said upper cooling surface upon rotation of said output shaft; and a second fan coupled for rotation with said input shaft, said second fan directing air toward said compressor.

18. The air compressor pump of claim 17 wherein said input shaft is laterally displaced from and coupled for rotation with said output shaft by a drive linkage.

19. The air compressor pump of claim 18 wherein said motor and said compressor are fixedly mounted to a frame.

20. The air compressor pump of claim 19 wherein said motor and said compressor are arranged laterally with respect to a longitudinal axis of said frame.

* * * * *